US006345401B1

(12) United States Patent
Frydman

(10) Patent No.: US 6,345,401 B1
(45) Date of Patent: Feb. 12, 2002

(54) NECK SUPPORT PILLOW

(76) Inventor: Larry G. Frydman, 195 Charles St., Thornhill (CA), L4J 3A2

( * ) Notice: Subject to any disclaimer, the term of this patent is extended or adjusted under 35 U.S.C. 154(b) by 0 days.

(21) Appl. No.: 09/400,167

(22) Filed: Sep. 21, 1999

(51) Int. Cl.[7] ..... A47G 9/00; A47C 20/08
(52) U.S. Cl. ..... 5/636; 5/640; 5/722; 5/723
(58) Field of Search ..... 5/636, 632, 640, 5/643, 657, 645, 637, 722, 723, 731, 727

(56) References Cited

U.S. PATENT DOCUMENTS

| | | | | | |
|---|---|---|---|---|---|
| 2,604,642 | A | * | 7/1952 | Marco | 5/727 |
| 3,083,380 | A | * | 4/1963 | Adler | 5/727 |
| 3,210,781 | A | * | 10/1965 | Pollock | 5/727 X |
| 3,553,068 | A | * | 1/1971 | Coale | 428/174 |
| 3,742,528 | A | * | 7/1973 | Mönch | 5/723 |
| 3,829,917 | A | * | 8/1974 | De Laittre et al. | 5/636 |
| 3,885,258 | A | * | 5/1975 | Regan | 5/727 |
| 4,053,957 | A | * | 10/1977 | Regan | 5/727 |
| 4,235,472 | A | * | 11/1980 | Sparks et al. | 5/637 X |
| 4,731,891 | A | | 3/1988 | Scheurer et al. | 5/434 |
| 4,748,702 | A | * | 6/1988 | Sandler | 5/636 |
| 4,771,493 | A | * | 9/1988 | Park | 5/637 |
| 4,777,678 | A | | 10/1988 | Moore | 5/431 |
| 4,794,657 | A | | 1/1989 | Avery | 5/431 |
| 4,821,355 | A | * | 4/1989 | Burkhardt | 5/636 |
| 4,832,007 | A | * | 5/1989 | Davis, Jr. et al. | 5/636 X |
| 5,237,714 | A | | 8/1993 | Baron | 5/636 |
| 5,257,429 | A | | 11/1993 | Genis | 5/636 |
| 5,360,017 | A | | 11/1994 | Austin | 128/845 |
| 5,524,640 | A | * | 6/1996 | Lisak et al. | 5/722 X |
| 5,528,784 | A | | 6/1996 | Painter | 5/640 |
| 5,615,432 | A | | 4/1997 | Von Ohlen, III | 5/638 |
| 5,642,543 | A | | 7/1997 | Huntley | 5/640 |
| 5,644,809 | A | * | 7/1997 | Olson | 5/636 |
| D385,451 | S | | 10/1997 | Pujals, Jr. | D6/601 |
| D394,977 | S | | 6/1998 | Frydman | D6/601 |
| 5,781,947 | A | | 7/1998 | Sramek | 5/636 |
| 5,926,880 | A | * | 7/1999 | Sramek | 5/636 |
| 5,953,779 | A | * | 9/1999 | Schwartz | 5/722 |
| 6,006,380 | A | * | 12/1999 | Sramek | 5/636 |
| 6,079,066 | A | * | 6/2000 | Backlund | 5/636 |
| 6,085,373 | A | * | 7/2000 | Montana | 5/722 |
| 6,182,314 | B1 | * | 2/2001 | Frydman | 5/632 X |

FOREIGN PATENT DOCUMENTS

| | | | | |
|---|---|---|---|---|
| FR | 2504795 | * | 11/1982 | 5/636 |

OTHER PUBLICATIONS

Erfanian, P; Hagino, C.; Guerriero, R.; A Preliminary Study Assessing Adverse Effects of a Semi–Customized Cervical Pillow on Asymptomatic Adults, J. Can. Chiropr Assoc 1998; 42(3), pp 156–162.

* cited by examiner

*Primary Examiner*—Robert G. Santos
(74) *Attorney, Agent, or Firm*—Small Larkin, LLP

(57) ABSTRACT

An adjustable orthopedic support pillow which includes a contoured top layer, a plurality of supporting layers, each having tongue-and-groove structures to enable the contoured layer to be removably supported by one or more additional supporting layers.

3 Claims, 3 Drawing Sheets

NECK SUPPORT PILLOW

BACKGROUND OF THE INVENTION

1. Field of the Invention

The invention relates to adjustable orthopedic support pillows which can be mechanically customized to support a large variation of the size and preferences of individuals.

2. Description of Prior Art

Supportive pillows over the past thirty years have gone through many changes in seeking the ideal support surface for the head and neck. Variations included, but were not limited to the materials used for supportive nature of the pillow. It has generally been assumed that in creating the ideal sleep surface there would have to be a fine balance between support and comfort in order to maximize the benefit to the end user.

The consumer today has a multitude of choices when it comes to purchasing a pillow. Materials utilized for vary from down feathers, fiberfil, organic materials, granular materials, fluid filled and polyurethane foam.

Medical study and testing performed by Dr. Ruth Jackson has indicated that the best degree of support that a pillow could provide would be a pillow that actually supported the natural contour of the cervical lordotic curve. She proposed that a roll-like structure placed under the cervical spine would be the most beneficial in providing proper support for the neck. Since this early concept and design the cervical contour pillow has evolved into numerous variations. Although all have included the principal concept of a cervical roll support for the neck, none has considered variations in the dimensions of the anatomy of different individuals and how these differences relate to the ultimate effectiveness of a pillow on an individualized basis. For example, a supportive pillow that is ill fitting could be detrimental to the user because it forces the user to conform to the support rather than conforming the support to the user's individualized needs and/or preferences.

Various methods of customization of pillows for both the cervical and lumbar spine are known. However, these variations range from intricate systems of support that are either adjustable through an inflatable component, a fluid filled component, and/or attachment of components through the use of hook-and-loop fastening devices, zippers and/or strapping.

OBJECTS AND SUMMARY OF THE INVENTION

The present invention provides an orthopedic support pillow that can be customized in terms of height in order to fit an individual's needs and/or preferences without the use of accessory devices such as hook-and-loop, elastic bands, zippers and straps and the like.

It is therefore an object of this present invention to provide a pillow that provides support for the natural contour of the cervical lordosis, but can be customized to fit variations in the sizes and preferences of individuals.

DETAILED DESCRIPTION OF PREFERRED EMBODIMENTS

Figure 1:
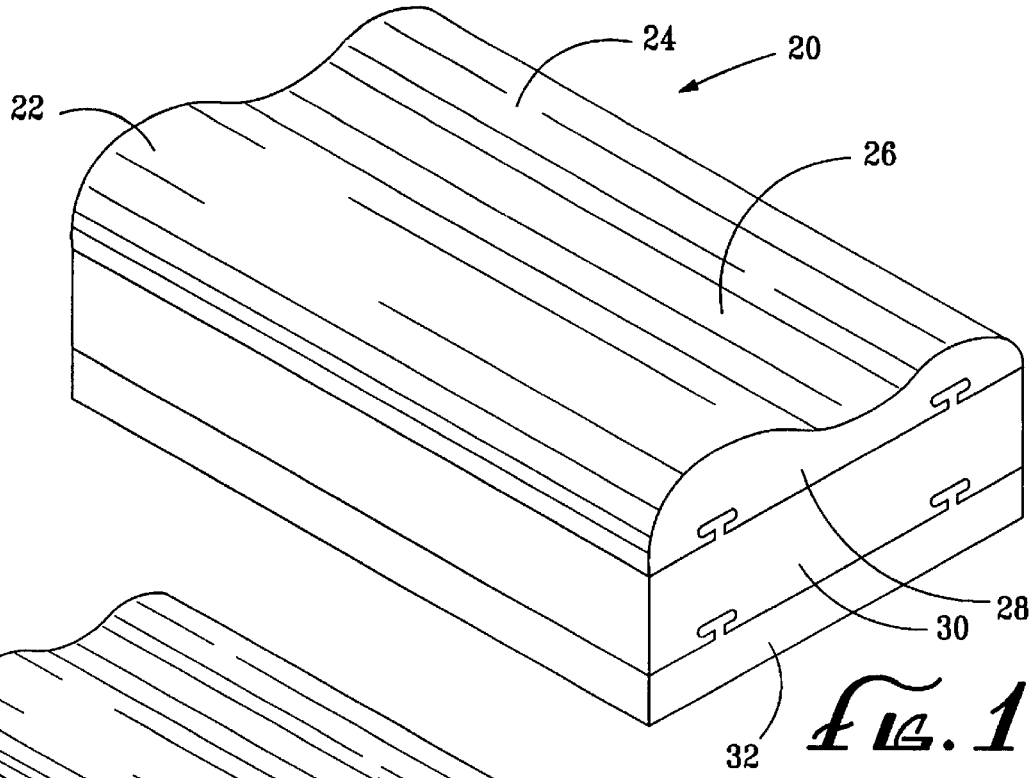
FIG. 1 is a side perspective view of a preferred embodiment of the present invention.

The preferred embodiment of the present invention is an adjustable orthopedic support pillow 20 that can be used by a user for sleeping either in the supine or side lying position. It includes of two semicylindrical support rolls 22, 24 of equal or, preferably of varying diameter which are symmetrical and which extend across to opposing ends of the pillow support surface. In FIG. 1 the roll 22 has a radius of curvature of about 3½ inches, and the roll 24 has a radius of curvature of about 3 inches. The FIG. 1 embodiment is the most preferred in terms of the radii of curvature. The region between and connecting the two semicylindrical support rolls is a valley 26 that functions to receive the head. In vertical dimension the structure includes three layers 28, 30 and 32, with only the top layer 28 having the semicylindrical support rolls 22,24 and valley surface 26.

The dimensions of the pillow of course may vary. However, it is believed that the minimum dimensions that are useful for adult humans would be about 12 inches in width by about 18 inches length by about 5 inches in height when fully assembled. Also, the support roll minimum diameter would be about 2½ inches, and about a ½ inch difference in diameter between the two rolls. This diameter difference provides for half sizes, to further fine tune the pillow's height to a particular individual's use.

Figure 2:
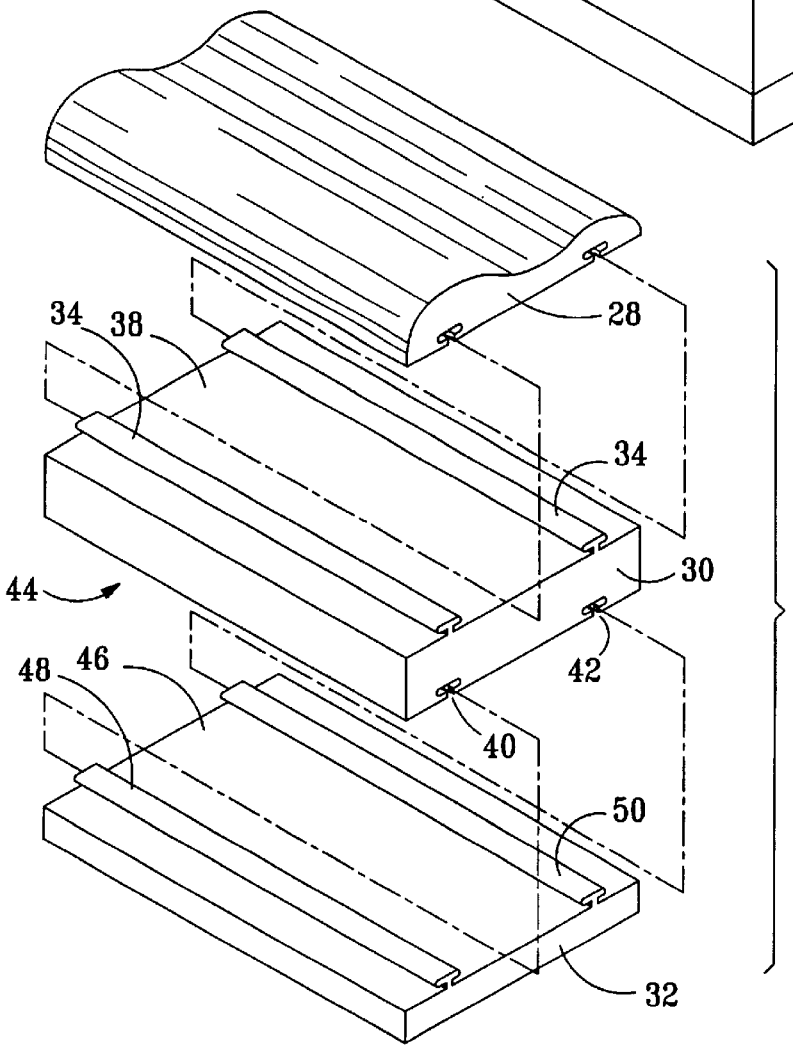
FIG. 2 is an exploded, side perspective view of the FIG. 1 embodiment.
Figure 3:
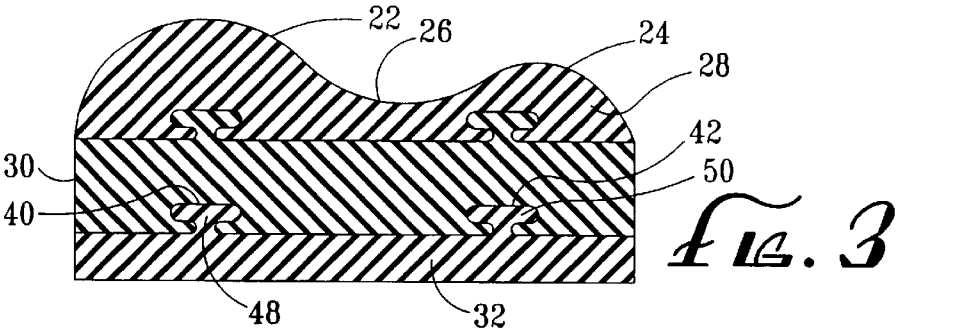
FIG. 3 is a side cross-sectional view of the FIG. 1 embodiment.

Referring to FIG. 2, the middle layer 30 includes a plurality of projections 34, 36 on its superior surface 38, and a plurality of conduits 40, 42 on its inferior surface 44. The bottom layer 32 includes a superior surface 46 having a plurality of projections 48,50. These projections 48, 50, when connected with the conduits 40, 42 of the middle layer 30 in a tongue-and-groove fashion, removably attach layer 32 to layer 30, and when projections 34, 36 are interconnected with the grooves (not numbered) in top layer 28, these layers are removably interconnected as shown in FIG. 3, to create a unitary support structure for the pillow's surface 28 or layer.

Figure 6:
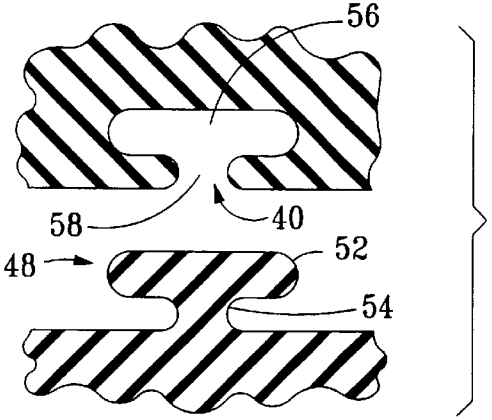
FIG. 6 is an enlarged cross-sectional view of a preferred tongue-in-groove connection of the FIG. 1 embodiment.

With reference to FIG. 6, projection 48 includes a cap 52 distally and proximally a shaft 54. The channel 40 is a negative image, or cavity of the projection 48 with a cap receiving area 56 and shaft receiving area 58. The diameter of the shaft 54 is somewhat narrower than, and is positioned axially to the cap 52, resulting in the lateral borders of the cap 52 protruding symmetrically laterally. When engagement between layers has occurred, the one layer that is proximally attached to the shaft 54 and the layer that is attached to the shaft receiving area 58 are connected and act as a unitary body.

Figure 4:
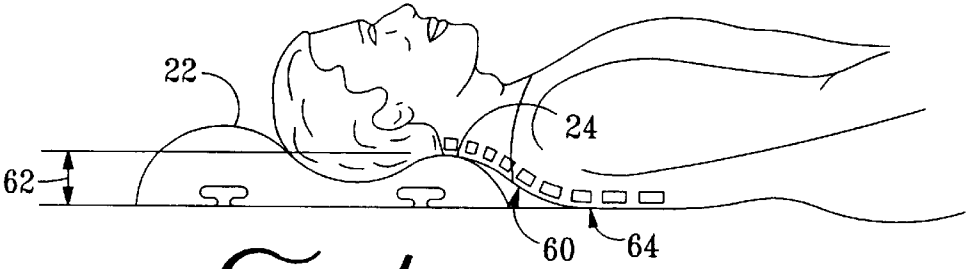
FIG. 4 is a side view of the top layer of the preferred embodiment, illustrating its use with a person sleeping on his/her back.
Figure 5:
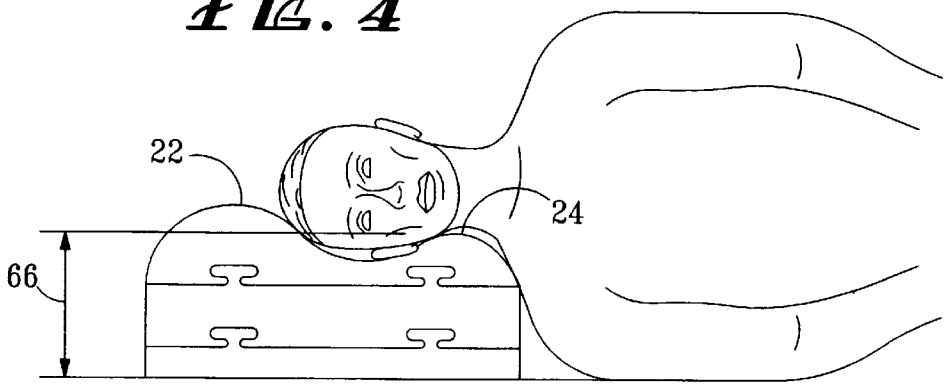
FIG. 5 is a side view of the FIG. 1 embodiment, illustrating use of all three layers in use with a person sleeping on his/her side.

For back sleeping, as show in FIG. 4, it is important to provide the appropriate support to the cervical lordotic curve 60 which is supported by either of the semicylindrical support rolls 22, 24, roll 24 being used in the FIG. 4 illustration. The effectiveness of these semicylindrical support rolls 22, 24 is directly related to the height of convexity 62 of the thoracic spine 64. A greater the convexity of the thoracic spine 64 curve would require a larger vertical dimension of the semicylindrical support rolls, as well as a valley, for supporting the head. Because convexities do vary from individual to individual it is an important feature of the present invention that the vertical height of the structures that support the semicylindrical support rolls 22, 24, and the valley 26 may be varied to provide the support necessary and/or preferred for any individual. While the height of support layer 30 may be the same as the height of layer 32, the heights may also be chosen to be different, and curvatures other than semicylindrical may also be used In the side lying position, show in FIG. 5, it is preferable to maintain the neck in a neutral anatomical position. The distance from shoulder to neck 66 will vary from individual to individual. By varying the height of the semicylindrical support rolls 22, 24, and the valley 26, such as by adding or removing a middle layer 30 or bottom layer 32, or choosing which of rolls 22, 24 is under the neck (roll 24 is under the neck in FIG. 5), customization capability is provided for optimum individualized support.

In the preferred embodiment the dimensions are chosen so that relatively large individuals (larger 10% of population) would require all three layers to be in position in order to provide support for the natural curvature of their cervical spine. The average individual (average height and weight) would only require two layers and at the other end of the range, slight individuals would only require a single layer of support.

In addition to individual size and side of sleeping, other factors could influence the chosen vertical height and radius of curvature of the support pillow of the present invention. For example, whether the individual is predominantly a stomach or side sleeper, types of inherent deformity to the spinal curvature and, most importantly, the individualized preference would be considered in making, and using a particular pillow configuration within the scope of the present invention.

Figure 7:
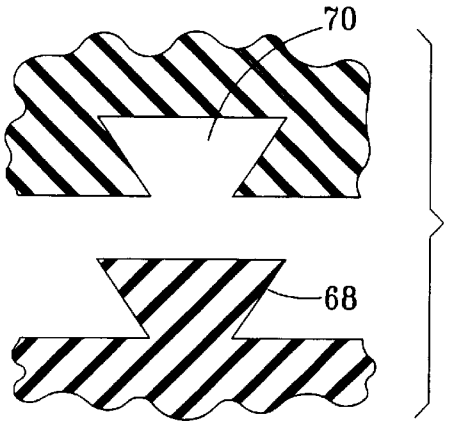
FIG. 7 is a cross-sectional view of an alternate preferred connection for use in the present invention.

Referring to FIG. 7, an enlarged, cross-sectional view of an alternate tongue-and-groove connection for use in the present invention is shown. A trapezoidal shaped projection 68 extends from the top, or superior surface of a layer and is sized and configured to fit into a corresponding trapezoidal cross-section channel or cavity 70 in the bottom surface of the adjoining, upper layer.

Figure 8:
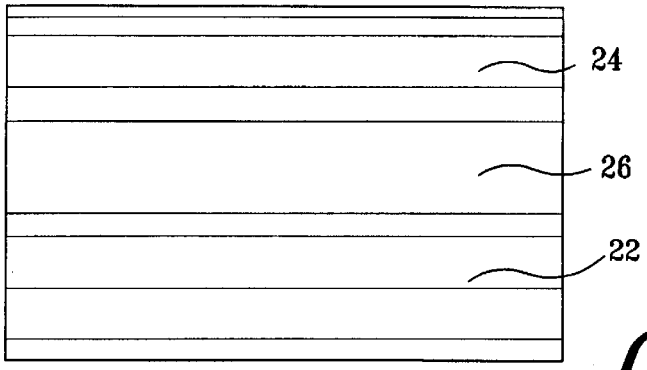
FIG. 8 is a top view of the FIG. 1 embodiment.
Figure 9:
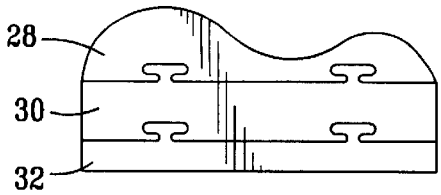
FIG. 9 is a side view of the FIG. 1 embodiment.

FIG. 8 is a top view of the FIG. 1 embodiment showing the rolls 22, 24 and the valley 26. FIG. 9 is a side view of the FIG. 1 embodiment showing upper layer 28, middle layer 30 and lower layer 32.

Figure 12:
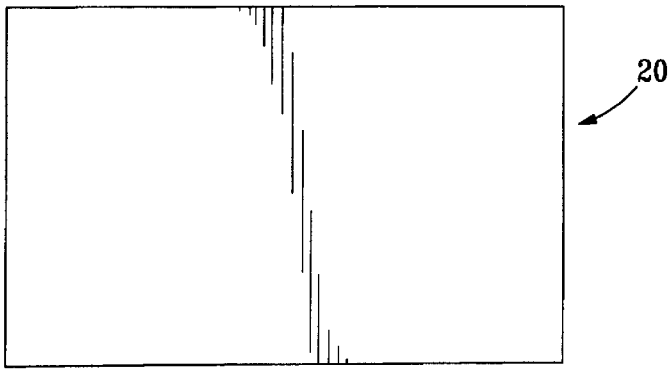
FIG. 12 is a bottom view of the FIG. 1 embodiment.
Figure 10:
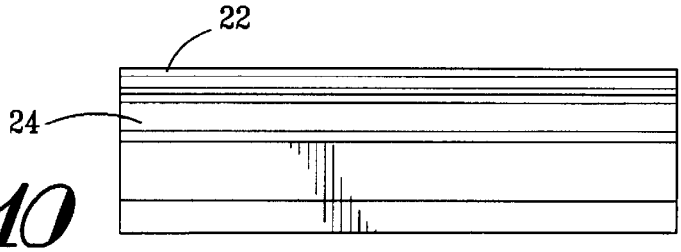
FIG. 10 is a back view of the FIG. 1 embodiment showing the roll 24 in the foreground and the top of roll 22 in the background.
Figure 11:
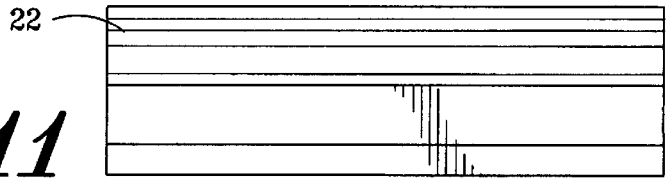
FIG. 11 is a front view of the FIG. 1 embodiment showing roll 22 in the foreground.

FIG. 10 is a back view of the FIG. 1 embodiment, showing the roll 22 in the background. FIG. 11 is a front view of the FIG. 1 embodiment with the roll 22 shown in the front position. FIG. 12 is a bottom view of the FIG. 1 embodiment.

The preferred material of construction for the present invention is a polyurethane foam, most preferably a commercial grade, such as 1035 RB12, or better. Another preferred embodiment, not illustrated, uses a viscoelastic foam, also known as memory foam, grade 1041 RBR foam, for the top layer, i.e., the contoured layer. Other materials of construction may be used, so long as they provide resiliency and support sufficient to function as a pillow.

Various modifications to the above-described invention are considered to be within those skilled in the present art, without departing from the spirit and scope of the invention is here and after defined by the appended claims. While the present invention has been described in connection with what are presently considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be afforded the broadest interpretation so as to encompass all such modifications and equivalent structures.

I claim:

1. An adjustable neck support pillow comprising:

a first layer having a first, contoured surface and a second surface having at least one cavity extending along a length dimension of the first layer; and a second layer having a first surface having at least one projection that fittingly and removably engages the at least one cavity of the first layer and having a second surface having at least one cavity extending along a length dimension of the second layer.

2. An adjustable neck support pillow comprising:

a first layer having a first, contoured surface and a second surface having at least one cavity extending along a length dimension of the first layer; and a second layer having a first surface having at least one projection that fittingly and removably engages the at least one cavity of the first layer;

a second surface on said second layer, said second surface opposite said first surface of said second layer; and at least one lower layer, where each of the second and lower layers have opposite surfaces and combinations of conduits or projections on either said opposite surface.

3. An adjustable neck support pillow comprising:

a first layer having a first, contoured surface and a second surface having at least one cavity extending along a length dimension of the first layer; and a second layer having a first surface having at least one projection that fittingly and removably engages the at least one cavity of the first layer;

a second surface on said second layer, said second surface opposite said first surface of said second layer; and at least one lower layer;

a means of attaching one layer to another in varying combinations in order to provide a unitary functional unit where said means consists of a projection and conduit; and where each of the second and lower layers has opposite surfaces and combinations of conduits or projections on either said opposite surface where the first layer has either projection or conduits on only one surface.

* * * * *